US009604241B1

(12) United States Patent
Laurel

(10) Patent No.: US 9,604,241 B1
(45) **Date of Patent: *Mar. 28, 2017**

(54) CLEANING DEVICE WITH LIQUID CONDUCTING UNIVERSAL JOINT

(71) Applicant: Bryan Laurel, Bayfield, CO (US)

(72) Inventor: Bryan Laurel, Bayfield, CO (US)

(73) Assignee: Bryan D. Laurel, Bayfield, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/225,383

(22) Filed: Aug. 1, 2016

Related U.S. Application Data

(63) Continuation of application No. 14/937,159, filed on Nov. 10, 2015, now Pat. No. 9,403,179.

(51) Int. Cl.
*B05B 15/06* (2006.01)
*B05B 15/08* (2006.01)
*A47L 13/26* (2006.01)

(52) U.S. Cl.
CPC ..... *B05B 15/067* (2013.01); *A47L 13/26* (2013.01); *B05B 15/065* (2013.01); *B05B 15/066* (2013.01); *B05B 15/08* (2013.01)

(58) Field of Classification Search
CPC ..... B05B 1/185; B05B 15/065; B05B 15/066; B05B 15/067; B05B 15/069; B05B 15/08
See application file for complete search history.

(56) References Cited

U.S. PATENT DOCUMENTS 5,988,920 A * 11/1999 Kunkler ..... B25G 1/06 239/587.5
7,806,351 B1 * 10/2010 Bakas ..... B05B 9/01 239/195
8,205,293 B2 * 6/2012 Rosenzweig ..... A47L 13/22 15/320
8,677,552 B2 * 3/2014 Krebs ..... A47L 11/4036 15/320
9,155,440 B2 * 10/2015 Nuttall ..... A47L 11/34
2002/0166906 A1 * 11/2002 Coles ..... B08B 3/028 239/526
2002/0194693 A1 * 12/2002 Wu ..... A47L 9/242 15/322
2012/0222227 A1 * 9/2012 Johnson ..... A47L 11/4002 15/105

* cited by examiner

*Primary Examiner* — Ryan Reis

(57) ABSTRACT

Cleaning device includes shaft that interfaces with fluid source and defines conduit. Mounting couples to cleaning element and includes interior and apertures. Liquid conducting universal joint is coupled with mounting and shaft. Joint includes a nozzle coupled to shaft that is in fluid communication with conduit. Nozzle includes nozzle mating feature defining nozzle aperture. Joint includes rotational element having first mating feature rotationally coupled with nozzle mating feature and is rotatable about radial axis of nozzle mating feature and second mating feature. Rotational fluid conduit extends between mating features. Joint includes connector coupled with mounting that defines connector conduit. Connector mating feature is rotatably coupled with second mating feature and is rotatable about radial axis of second mating feature that is substantially orthogonal to radial axis of nozzle mating feature. Cleaning device defines rigid fluid path that enables rotation of mounting without bending components that define fluid path.

20 Claims, 12 Drawing Sheets

CLEANING DEVICE WITH LIQUID CONDUCTING UNIVERSAL JOINT

CROSS-REFERENCES TO RELATED APPLICATIONS

This application claims the benefit of priority to and is a continuation of U.S. patent application Ser. No. 14/937,159, filed Nov. 10, 2015, entitled "Cleaning Device With Liquid Conducting Universal Joint" which is herein incorporated by reference in its entirety for all purposes.

BACKGROUND OF THE INVENTION

Cleaning showers and tile walls and floors in commercial or institutional restrooms is often the most time consuming and labor intensive aspect of a cleaning professional's daily routine. Cleaning procedures for such projects typically involve three basic steps: 1) apply a cleaning agent to the surface to be cleaned, 2) scrub the surface with an abrasive pad, and 3) rinse the surface with a hose or bucket. This process may be time consuming and may cause fatigue in the cleaning professional. As a result, shortcuts are often taken, leading to unclean surfaces.

Conventional cleaning equipment typically lacks the ability to deliver a controlled stream of water, cleaning solution, and/or other fluid to flush dirt and/or soap residue from the surface. Furthermore, many facilities have converted plumbing fixtures to "low flow" as a means of water conservation. These fixtures reduce the efficiency of cleaning procedures that require water to rinse surfaces. Typically, water flow brushes offer single direction pivoting or fixed-angle heads that are bulky and not ideal for cleaning showers, tile walls, or floors in restrooms and other facilities. Additionally, conventional products that do offer dual pivoting heads include flexible tubing that bends and flexes as the head pivots. This tubing can kink up or separate completely, preventing a strong, reliable flow of fluid. Additionally, the flexing and bending of these tubes as the heads pivot causes the flexible tubing to wear out over time, causing leaks and a reduction of fluid pressure. Flexible tubes also require one or more adapters to connect various tubing and port sizes throughout a cleaning device, thus increasing the cost and complexity of the cleaning devices.

BRIEF SUMMARY OF THE INVENTION

Embodiments of the invention provide cleaning devices that direct water and/or other cleaning fluids through a pivotable joint to a cleaning element. The cleaning devices are configured such that the cleaning element may pivot relative to a shaft about at least two substantially orthogonal axes, enabling easy cleaning of floors, ceilings, and walls. The cleaning device utilizes a liquid conducting universal (LCU) joint to provide the rotation. The LCU joint defines a rigid, but pivotable path for the fluid, thus eliminating the need for flexible tubing that may wear out and/or leak over time. Additionally, the LCU joints described herein may eliminate the need for size adaptors for various sizes of flexible tubing.

In one aspect, a cleaning device is provided. The cleaning device may include a shaft having a proximal end and a distal end. The proximal end may be configured to interface with a fluid source. The shaft may include a fluid conduit extending along a length of the shaft. The cleaning device may also include a mounting configured to removably couple to a cleaning element. The mounting frame may define a frame interior in communication with one or more fluid apertures. The cleaning device may further include a liquid conducting universal (LCU) joint coupled with the mounting and the distal end of the shaft such that the mounting is pivotally coupled with the shaft.

The LCU joint may include a nozzle coupled to the distal end of the shaft such that an interior of the nozzle is in fluid communication with the fluid conduit. The nozzle may include a first nozzle mating feature and a second nozzle mating feature positioned on an opposite side of the nozzle as the first nozzle mating feature. The first nozzle mating feature and the second nozzle mating feature each define nozzle apertures.

The LCU joint may also include a first rotational element having a first top mating feature and a first bottom mating feature. The first top mating feature may be rotatably coupled with the first nozzle mating feature such that the first rotational element is rotatable about a radial axis of the first nozzle mating feature. The first rotational element may define a first conduit that extends between the first top mating feature and the first bottom mating feature. The LCU joint may further include a second rotational element having a second top mating feature and a second bottom mating feature. The second top may be rotatably coupled with the second nozzle mating feature such that the second rotational element is rotatable about a radial axis of the second nozzle mating feature. The second rotational element may define a second conduit that extends between the second top mating feature and the second bottom mating feature.

The LCU joint may include a first connector coupled with the mounting. The first connector may define a first connector conduit in fluid communication with a first connector mating feature and the one or more fluid apertures. The LCU joint may also include a second connector coupled with the mounting. The second connector may include a second connector conduit in fluid communication with a second connector mating feature and the one or more fluid apertures.

The LCU joint may further include a rotatable fluid port having a first port mating feature and a second port mating feature. The first port mating feature may be rotatably coupled with the first bottom mating feature and the second port mating feature may be rotatably coupled with the second bottom mating feature such that the rotatable fluid port is rotatable about a radial axis of the first bottom mating feature and the second bottom mating feature. The rotatable fluid port may also include a third port mating feature and a fourth port mating feature positioned on an opposite side of the rotatable fluid port as the third port mating feature. The third port mating feature may be rotatably coupled with the first connector mating feature and the fourth port mating feature may be rotatably coupled with the second connector mating feature such that the first connector and second connector are rotatable about a radial axis of the third port mating feature and the fourth port mating feature.

The radial axis of the third port mating feature and the fourth port mating feature may be substantially orthogonal to the radial axis of the first bottom mating feature and the second bottom mating feature such that the mounting is pivotable relative to the shaft about two substantially orthogonal axes. The fluid conduit, the interior of the nozzle, the nozzle apertures, the first conduit and the second conduit, the rotatable fluid port, the first connector conduit and the second connector conduit, the frame interior, and the one or more fluid apertures may define a rigid fluid path configured to direct a fluid from the fluid source to the cleaning element. The rigid fluid path may enable the rotation of the mounting relative to the shaft without bending any components that define the rigid fluid path.

In another aspect, a cleaning device may include a shaft having a proximal end and a distal end. The proximal end may be configured to interface with a fluid source. The shaft may include a fluid conduit extending along a length of the shaft. The cleaning device may also include a mounting configured to removably couple to a cleaning element. The mounting frame may define a frame interior in communication with one or more fluid apertures. The cleaning device may further include a liquid conducting universal (LCU) joint coupled with the mounting and the distal end of the shaft such that the mounting is pivotally coupled with the shaft.

The LCU joint may include a nozzle coupled to the distal end of the shaft such that an interior of the nozzle is in fluid communication with the fluid conduit. The nozzle may include a nozzle mating feature. The nozzle mating feature may define a nozzle aperture. The LCU joint may also include a rotational element having a first mating feature and a second mating feature. The first mating feature may be rotatably coupled with the nozzle mating feature such that the rotational element is rotatable about a radial axis of the nozzle mating feature. The rotational element may define a conduit that extends between the first mating feature and the second mating feature.

The LCU joint may further include a connector coupled with the mounting. The connector may define a connector conduit in fluid communication with a connector mating feature and the one or more fluid apertures. The LCU joint may include a rotatable fluid port comprising a first port mating feature and a second port mating feature. The first port mating feature may be rotatably coupled with the second mating feature such that the rotatable fluid port is rotatable about a radial axis of the second mating feature. The second port mating feature may be rotatably coupled with the connector mating feature such that the connector is rotatable about a radial axis of the second port mating feature The radial axis of the second port mating feature may be substantially orthogonal to the radial axis of the second mating feature such that the mounting is pivotable relative to the shaft about two substantially orthogonal axes. The fluid conduit, the interior of the nozzle, the nozzle aperture, the conduit, the rotatable fluid port, the connector conduit, the frame interior, and the one or more fluid apertures may define a rigid fluid path configured to direct a fluid from the fluid source to the cleaning element. The rigid fluid path may enable the rotation of the mounting relative to the shaft without bending any components that define the rigid fluid path.

In another aspect, a cleaning device may include a shaft having a proximal end and a distal end. The proximal end may be configured to interface with a fluid source. The shaft may include a fluid conduit extending along a length of the shaft. The cleaning device may also include a mounting configured to removably couple to a cleaning element. The mounting frame may define a frame interior in communication with one or more fluid apertures. The cleaning device may further include a liquid conducting universal (LCU) joint coupled with the mounting and the distal end of the shaft such that the mounting is pivotally coupled with the shaft.

The LCU joint may include a nozzle coupled to the distal end of the shaft such that an interior of the nozzle is in fluid communication with the fluid conduit. The nozzle may include a nozzle mating feature. The nozzle mating feature may define a nozzle aperture. The LCU joint may also include a rotational element having a first mating feature and a second mating feature. The first mating feature may be rotatably coupled with the nozzle mating feature such that the rotational element is rotatable about a radial axis of the nozzle mating feature. The rotational element may define a conduit that extends between the first mating feature and the second mating feature. The LCU joint may further include a connector coupled with the mounting. The connector may define a connector conduit in fluid communication with a connector mating feature and the one or more fluid apertures. The connector mating feature may be rotatably coupled with the second mating feature such that the connector element is rotatable about a radial axis of the second mating feature.

The radial axis of the nozzle mating feature may be substantially orthogonal to the radial axis of the second mating feature such that the cleaning element mounting is pivotable relative to the shaft about two substantially orthogonal axes. The fluid conduit, the interior of the nozzle, the nozzle aperture, the conduit, the connector conduit, the frame interior, and the one or more fluid apertures may define a rigid fluid path configured to direct a fluid from the fluid source to the cleaning element. The rigid fluid path may enable the rotation of the mounting relative to the shaft without bending any components that define the rigid fluid path.

In another aspect, A cleaning device may include a shaft having a proximal end and a distal end. The proximal end may be configured to interface with a fluid source. The shaft may include a fluid conduit extending along a length of the shaft. The cleaning device may also include a conduit coupled with the distal end of the shaft such that the conduit is rotatable about a first axis of the conduit. The cleaning device may further include a mounting frame coupled with the conduit and configured to rotate about a second axis of the conduit. The mounting frame may be configured to removably couple to a cleaning element. The mounting frame may define a frame interior in communication with one or more fluid apertures. The first axis may be substantially orthogonal to the second axis such that the mounting frame is pivotable relative to the shaft about two degrees of freedom. The fluid conduit, the conduit, the connector conduit, the frame interior, and the one or more fluid apertures may define a rigid fluid path configured to direct a fluid from the fluid source to the cleaning element. The rigid fluid path may enable the rotation of the mounting frame relative to the shaft without bending any components that define the rigid fluid path.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

Figure 1:
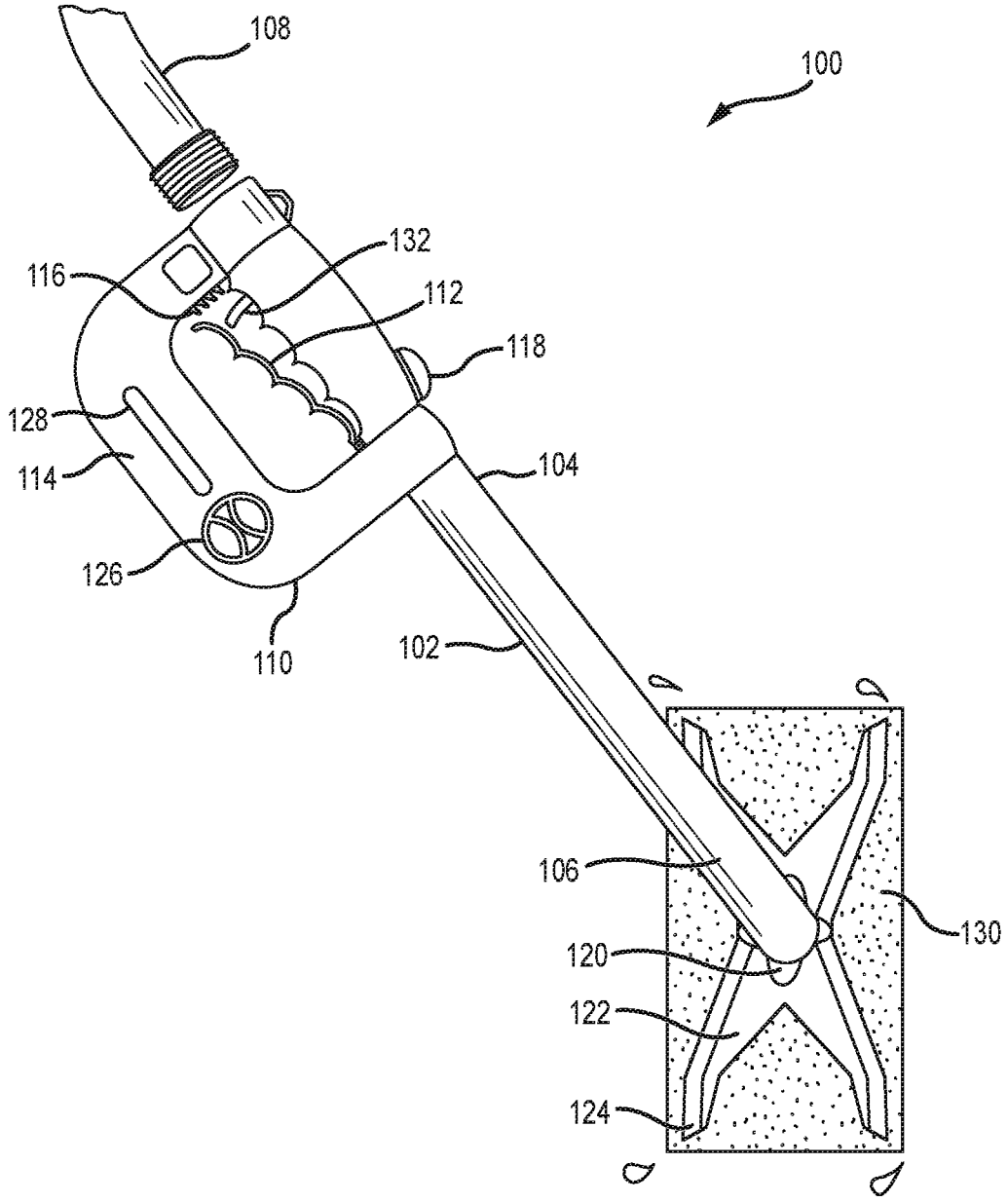
FIG. 1 shows a cleaning device according to embodiments.

Embodiments of the invention are directed to dual-pivoting cleaning devices that deliver a fluid to a surface to be cleaned. The cleaning devices utilize a liquid conducting universal (LCU) joint that enables dual-axis rotation while defining a fluid path entirely within components of the LCU joint such that no flexible tubing or other shape changing components are needed to direct fluid to a cleaning element. The fluid path itself may change shape as the LCU joint is rotated, and the components thereof may rotate relative to one another, but the components do not bend or flex. Each of the LCU joint components may be rigidly formed such that there is no wear due to flexing pieces. This prevents leaks and damage of the cleaning device. The LCU joint may direct the fluid to a cleaning element, such as a brush, sponge, or abrasive pad. The cleaning element may be removably coupled with a frame such that cleaning elements may be interchanged, removed for cleaning and/or replacement, and/or removed for any other purpose. By making the cleaning elements interchangeable, the cleaning device becomes more versatile. The cleaning device may be used to clean various surfaces. For example, soft bristles or a soft pad may be used to wash a vehicle, a push broom attachment may be used to clean a garage or driveway, and an abrasive brush or pad may be used to clean bathroom and/or industrial surfaces.

The embodiments described herein relate to lightweight cleaning devices that can withstand the high demands of cleaning showers and institutional restrooms and/or locker rooms by allowing the user to combine continuous water flow and/or flow of a cleaning solution with the aggressive scrubbing power of a dual-pivoting, position-maintaining brush. The cleaning devices provide mechanical leverage to users, allowing the user to reach high and low while the water and/or cleaning solution effortlessly rinses filth and debris to a floor drain. The cleaning devices described herein are robust, capable of withstanding continuous force attributed with scrubbing, and the tubeless design of the LCU joint prevents leaks and increases the durability of the cleaning devices.

The dual-pivoting cleaning devices described herein may include a shaft that defines a fluid conduit such that a hose or other fluid source may be attached to the cleaning device. For example, a threaded connector that interfaces with a hose connector may be used to connect the fluid source. In other embodiments, a self-sealing quick connect mechanism may be utilized such that a hose or other fluid source may be quickly snapped into place. Such a connector may enable the cleaning device to be used in multiple rooms and with different fluid sources without a user needing to constantly screw and unscrew hoses from the cleaning device. Quick connect mechanisms may be designed to receive a standard or other size of hose and align the hose with the fluid conduit of the cleaning device. The fluid conduit of the shaft may be sized to control a fluid pressure, as well as a maximum weight of the fluid within the cleaning device to ensure that the cleaning device is lightweight for easy use. In some embodiments, the shaft may be insulated, such as by having a rubber or other synthetic layer that may protect a user from high temperature water flowing through the cleaning device.

The cleaning device and components thereof may be formed of rigid materials, such as metals, plastics, and/or other synthetics. The materials may be selected based on considerations such as cost, weight, durability, ease of manufacturing, and the like. In joint locations, such as where rotatable components are joined, O-rings, gaskets, and/or other seals may be provided to help ensure that the fluid path remains leak-free. The components of the cleaning device may be injection molded, 3-D printed, and/or otherwise formed. The size of the cleaning device and components thereof may be sized to match the needs of a particular application. The components may be removably coupled with one another, such as by using snap connectors, threaded connectors, other rotatable coupling methods, and/or other coupling methods such that the cleaning device may be removed for easy cleaning and/or replacement.

While discussed largely in relation to cleaning applications, the LCU joint described herein may be useful in other applications. Any applications that involve transporting a fluid through a movable joint, or applications where strength, balance, and flexibility are desirable, may benefit from utilizing the LCU joints described herein. For example, steam, paint, finish, solvents, degreasers, and/or other fluids may be applied using the LCU joint and/or a shaft and an applicator. The LCU joint may also be useful in conducting electricity through a pivot point where traditional wiring would be subject to excessive wear or foreign debris. The LCU joint may also be useful in hydraulic mechanisms as an alternative to flexible hoses.

Turning now to FIG. 1, one embodiment of a cleaning device 100 is shown. Cleaning device 100 includes a shaft 102 having a proximal end 104 and a distal end 106. The proximal end 104 may be configured to interface with a fluid source, such as a hose 108. In some embodiments, the interface may include a valve, such as a ball valve, that may be used to shut off and/or control the flow of fluid to the cleaning device 100. The interface between hose 108 and proximal end 104 may be threaded, such that hose 108 may be screwed into the proximal end 104. In other embodiments, a self-sealing quick connect adapter may be positioned on the proximal end 104 such that hose 108 and/or other fluid source may be quickly attached. For example, an end of hose 108 may be snapped into or otherwise clamped into the quick connect adapter such that the hose 108 is in fluid communication with a fluid conduit of the shaft 102. The fluid conduit may extend along the length of shaft 102 to direct fluid to a head of the cleaning device 100. Typically, the fluid conduit is defined by a hollow interior of the shaft 102, although it will be appreciated that a separate tube or conduit may run within and/or along the outside of the shaft 102.

The shaft 102 may be extendable such that it may be shortened and/or lengthened to meet the needs of a particular application and/or user. For example, the shaft 102 may telescope and lock to a desired length. Shaft 102 may be formed from any rigid material, such as a metal, a plastic, and/or another synthetic material. Oftentimes the shaft 102 may include a heat insulating material, such as a rubber or other polymer to insulate the shaft 102. This helps maintain a temperature of fluid within the shaft 102, as well as to prevent a surface of the shaft 102 from becoming too hot or cold for a user to hold. The heat insulating material may extend along the entire length of the shaft and/or may be disposed only at a handle 110 of the shaft 102.

The shaft 102 may include handle 110, which may be disposed near the proximal end 104. Handle 110 may include a flow actuator 112 configured to control a flow of the fluid through the fluid conduit. Handle 110 may also include a chemical reservoir 114 that may allow an additional fluid, such as a cleaning fluid to be used along with fluid from the fluid source or hose 108. The chemical reservoir 114 may be in fluid communication with the fluid conduit using one or more valves that may be controlled by a reservoir actuator or chemical release button 118. Upon actuation of the chemical release button 118, a volume of fluid within the chemical reservoir 114 may be introduced into the fluid flowing within the fluid conduit of shaft 102. The volume may be a measured amount for each actuation or the chemical may be continually introduced to the fluid conduit while the valve is open. When not actuated, the chemical release button 118 allows the valve to close and seal the chemical reservoir 114 from the fluid conduit. The fluid from the fluid source and/or the chemical reservoir 114 may pass through the fluid conduit, through an LCU joint 120, and into a head, mounting, or frame 122 of the cleaning device 100. The fluid may be ejected out of one or more fluid apertures or ports 124 defined by the frame 122. In some embodiments, the ports 124 may eject the fluid directly onto the surface to be cleaned, while in other embodiments, the ports 124 may eject the fluid onto or through a cleaning element 130 mounted on the frame 122. Cleaning element 130 may be an abrasive pad, a brush, a sponge, a mop head, a broom head, and/or other cleaning material. The frame 122 may be coupled with the cleaning element 130 using a hook and loop fastener, a snap connector, a magnetic connector, other removable fastening mechanisms, and/or combinations thereof.

Figure 2:
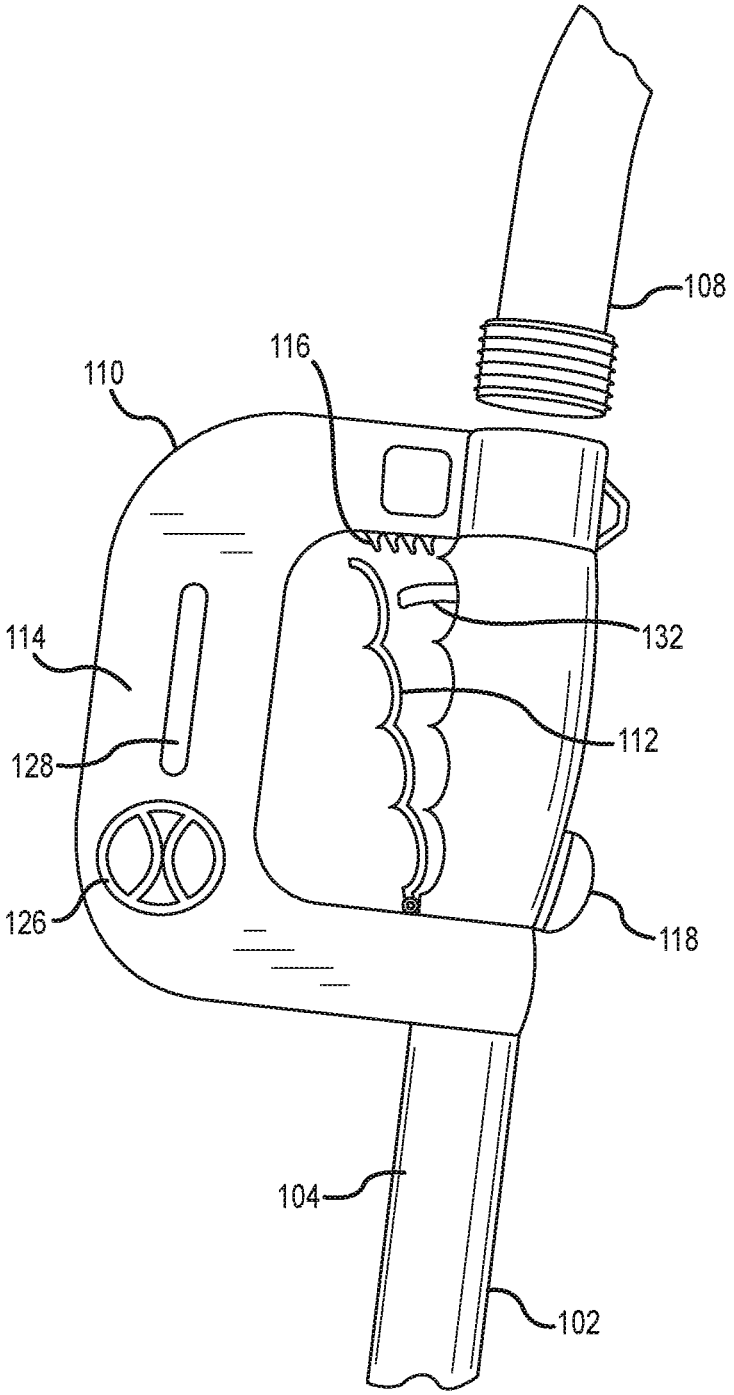
FIG. 2 shows a handle of the cleaning device of FIG. 1 according to embodiments.

FIG. 2 shows a more detailed view of handle 110 of cleaning device 100. In some embodiments, flow actuator 112 may be a trigger or other mechanism used to control a valve within the fluid conduit. Upon actuation, the flow actuator 112 may open the valve and allow the fluid to flow. For example, the flow actuator 112 may drive a plunger 132 or other mechanism that may open the valve. In some embodiments, actuation of the flow actuator 112 may cause a simple open/close action of the valve, such that the valve is either fully closed and/or fully opened. In other embodiments, the flow actuator 112 allows the user to control a degree of openness of the valve, which provides a full array of fluid flow rates and fluid pressures. In such embodiments, the flow actuator 112 is lockable in a number of positions Each of the positions may correspond to a different fluid flow rate. For example, a locking mechanism 116, similar to a pivoting lock of a fuel pump, may be positioned such that it may be engaged with an end of the flow actuator 112. A user may squeeze or otherwise manipulate the flow actuator 112 to a desired position and/or flow rate. The user may then pivot the lock mechanism 116 such that it is engaged with the end of the flow actuator 112. The lock mechanism 116 may then be pivoted to disengage the flow actuator 112, allowing the user to stop the flow of fluid through the cleaning device 100. In other embodiments, the lock mechanism may be biased to a closed position such that when the user manipulates the flow actuator 112, the flow actuator 112 engages teeth or other mating features of the locking mechanism 116 and is automatically locked into position. In this manner, locking mechanism 116 and flow actuator 112 may act as a ratcheting mechanism to allow a user to lock the position of the flow actuator 112. The harder a user squeezes, the higher the rate of flow that is locked. The locking mechanism 116 may then be disengaged by pressing on a portion of the locking mechanism 116 to move the locking mechanism 116 away from the flow actuator 112, allowing the user to stop the flow of fluid. Such locking mechanisms enable the user to select a flow rate and lock the flow actuator 112 at the selected flow rate such that the user may clean with a consistent flow. It will be appreciated that other mechanisms may be used to control and/or lock a position of the flow actuator 112. For example, a clamping mechanism or set screw may be used to lock the flow actuator 112 in a desired position.

The chemical reservoir 114 may be filled with a cleaning solution by removing a reservoir cap 126 to gain access to the chemical reservoir 114. Reservoir cap 126 may snap on, screw on, or otherwise be removably coupled to a port of the chemical reservoir 114. In some embodiments, a window 128 may be provided that allows the user to view an amount of the cleaning solution within the chemical reservoir 114. As noted above, chemical release button 118 may open a valve to introduce the cleaning solution into the fluid flowing within the fluid conduit of shaft 102. In some embodiments, the valve is configured such that when open, a low pressure area created by the flow from the fluid source or hose 108 draws the cleaning solution from the chemical reservoir 114 into the fluid conduit.

Figure 3:
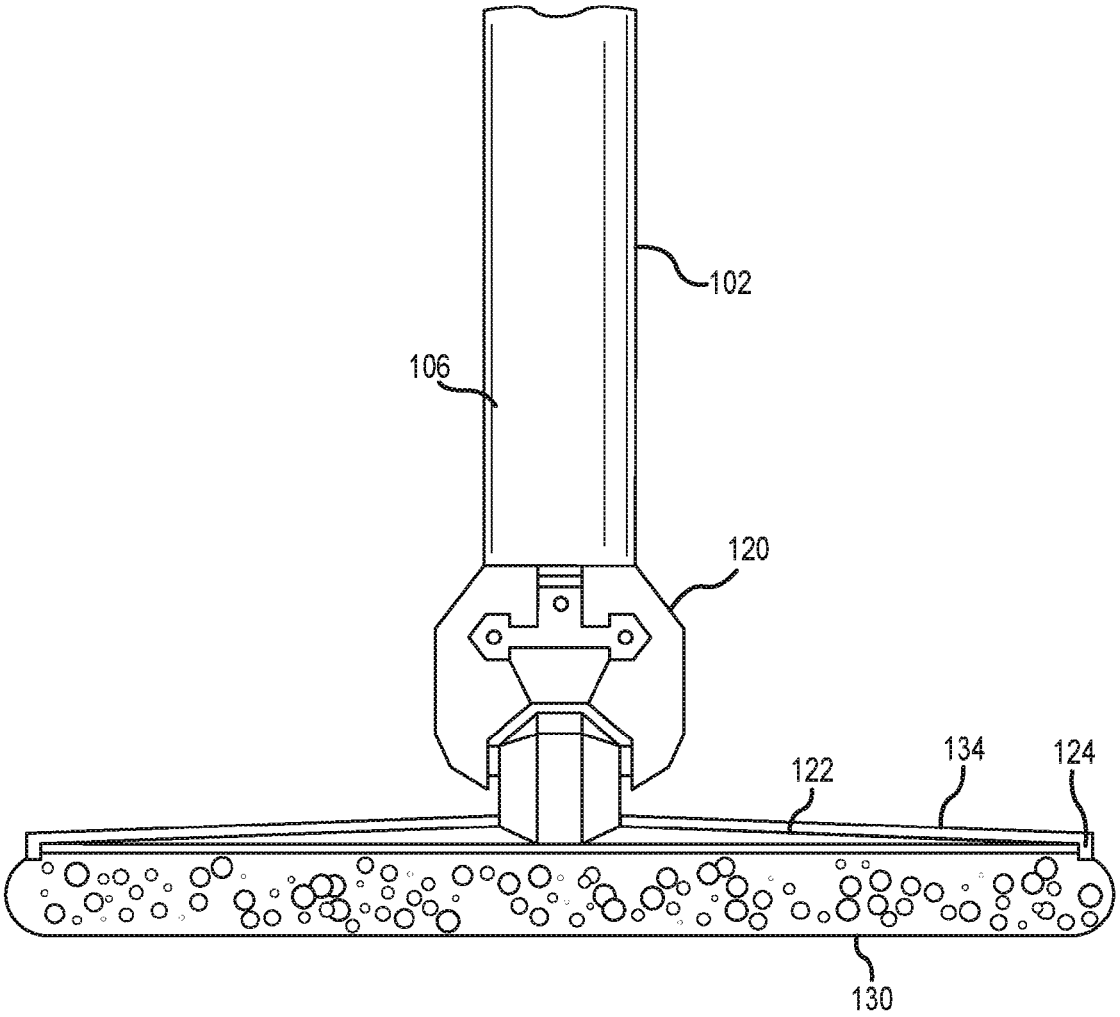
FIG. 3 shows a pivot joint of the cleaning device of FIG. 1 according to embodiments.
Figure 4:
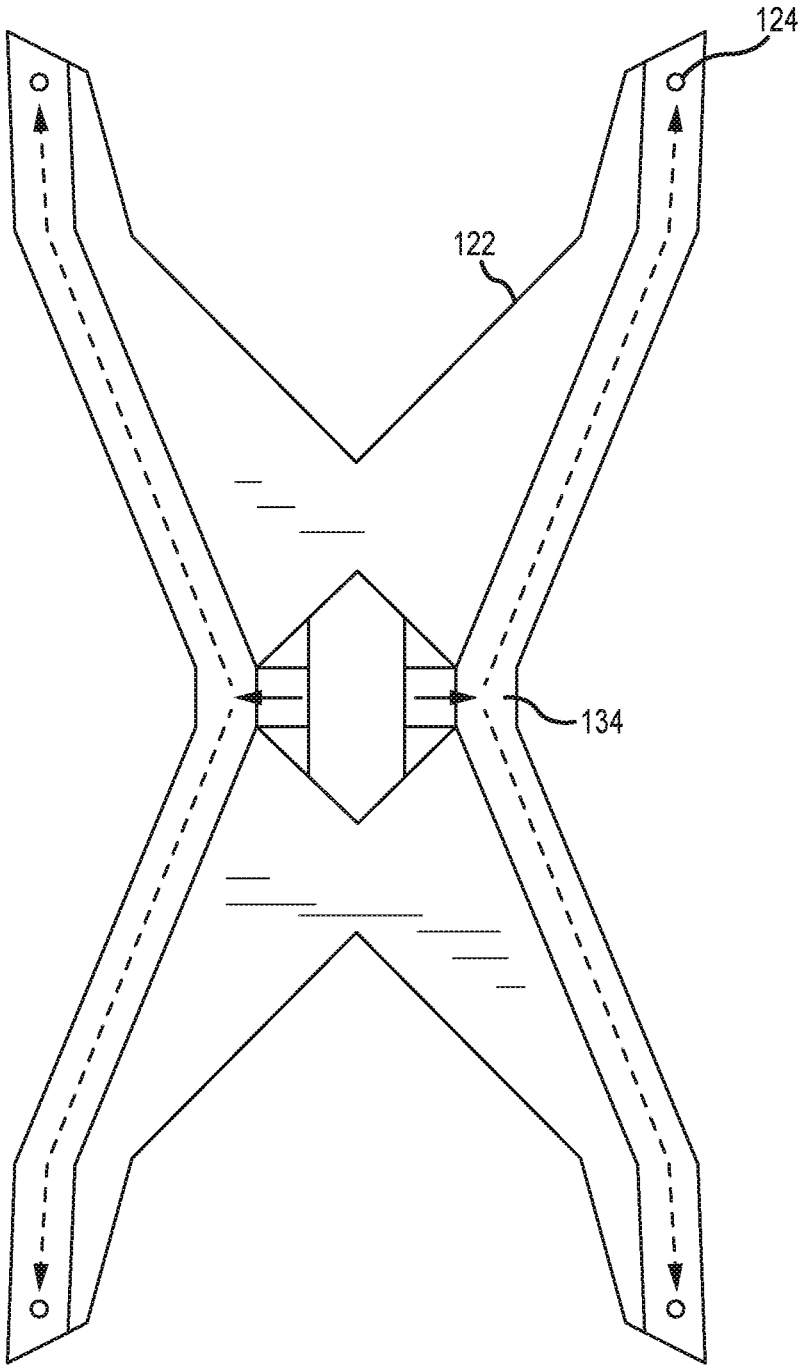
FIG. 4 shows a mounting frame of the cleaning device of FIG. 1 according to embodiments.

FIG. 3 depicts a more detailed view of the distal end 106 of shaft 102 and the mounting or frame 122. LCU joint 120 pivotably couples the frame 122 with distal end 106. Fluid from the fluid conduit of shaft 102 may flow through the LCU joint 120 into an interior of the frame 122 that is coupled with the LCU joint 120. The fluid may then pass through an interior 134 of the frame 122 and be ejected through the fluid ports 124 directly onto a surface to be cleaned and/or onto the cleaning element 130. As seen in FIG. 4, fluid ports 124 may be positioned at each of four corners of frame 122. In other embodiments, there may be one or more fluid ports 124 positioned at any position and in any pattern on the frame 122. While shown having an X-shape, the frame 122 may have any shape, such as a circular, oval, square, trapezoidal, and/or rectangular shape. Additionally, frame 122 may be sized to fit any number of cleaning elements 130 and/or to satisfy requirements of any cleaning application. For example, for cleaning large, flat floors and walls, the frame 122 may be large to support a large cleaning element 130, while smaller scale applications, and those with many protrusions, such as posts or pillars, extending from the cleaning surface, may require a smaller, more maneuverable frame 122.

In some embodiments, the fluid ports 124 may each include an adjustable valve that controls a pressure of the fluid. For example, the valve may serve as a nozzle that reduces a diameter of an opening of the aperture to increase fluid pressure. The adjustable valves may include several different settings, such that a user may rotate or otherwise manipulate each adjustable valve to achieve a desired fluid pressure. In some embodiments, the fluid ports 124 may be configured to soak the cleaning element 130 with the fluid, while in other embodiments, the fluid ports 124 may eject the fluid through the cleaning element 130 and onto the surface to be cleaned. As one example, the fluid ports 124 may be configured to direct the fluid through corresponding apertures defined by the cleaning element 130 such that the fluid is applied directly to a surface to be cleaned.

Figure 5:
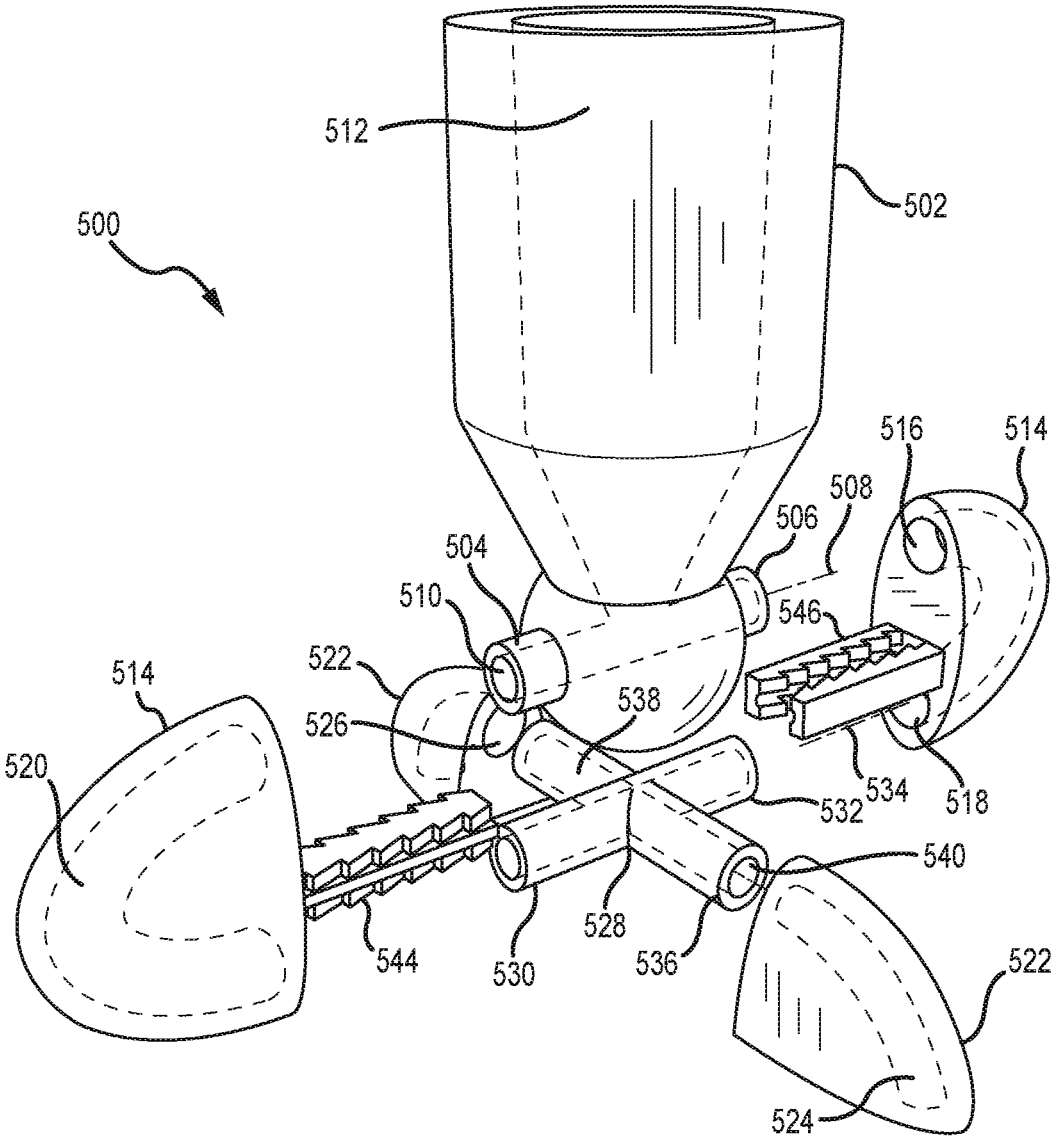
FIG. 5 shows an exploded view of an LCU joint according to embodiments.

FIGS. 5-8 depict one embodiment of an LCU joint 500. FIG. 5 shows an exploded view of LCU joint 500. LCU joint 500 may be similar to the LCU joint 120 and may be used in cleaning devices, such as cleaning device 100 described above. Oftentimes, the LCU joint 500 may be symmetrical, however, single sided and/or otherwise asymmetrical LCU joints may be used. LCU joint 500 may include a nozzle 502 that may be coupled to a distal end of a shaft such that an interior 512 of the nozzle is in fluid communication with the fluid conduit of a shaft. For example, the nozzle 502 may be snapped or screwed onto the distal end of the shaft to align the fluid conduit with the interior 512 of the nozzle 502. In some embodiments, the nozzle 502 may be formed integral with the shaft, such that the nozzle 502 and shaft are a single unit. The nozzle 502 may include a first nozzle mating feature 504 and a second nozzle mating feature 506 positioned on an opposite side of the nozzle 502 as the first nozzle mating feature 502. By positioning the first nozzle mating feature 504 and second nozzle mating feature 506 on opposite sides, the mating features may define a common radial axis 508 about which a portion of the LCU joint 500 may rotate. One or both of the first nozzle mating feature 504 and the second nozzle mating feature 506 may define nozzle apertures 510. The nozzle apertures 510 are in communication with the interior 512 such that fluid may pass from the interior 512 through the nozzle apertures 510, which direct the fluid into the rest of the LCU joint 500.

LCU joint 500 may also include one or more rotational elements 514, each having a top mating feature 516 and a bottom mating feature 518. The top mating feature 516 may be rotatably coupled with the first nozzle mating feature 504 or the second nozzle mating feature 506 such that the rotational elements 514 are rotatable about the radial axis 508 of the first nozzle mating feature 504 and second nozzle mating feature 506. The rotational elements 514 may define a conduit 520 that extends between the top mating feature 516 and the first bottom mating feature 518. In embodiments with only a single rotational element 514, the nozzle 502 may include only a single nozzle mating feature 504. In other embodiments, two rotational elements 514 may be included, with only one of them defining a fluid path. The non-fluid conducting rotational element may be used to provide a symmetrical design and/or to provide extra strength and support during rotation of the LCU joint 500.

LCU joint 500 may include one or more connectors 522 that may be coupled with a frame of a cleaning device. Each connector 522 may define a connector conduit 524 in fluid communication with a connector mating feature 526 and one or more fluid apertures of a mounting frame of a cleaning device. The LCU joint 500 may also include a rotatable fluid port 528 that includes a first port mating feature 530 and a second port mating feature 532. The first port mating feature 530 may be rotatably coupled with a bottom mating feature 518 of one of the rotational elements 514 and the second port mating feature 532 may be rotatably coupled with a bottom mating feature 518 of another of the rotational elements 514 such that the rotatable fluid port 528 is rotatable about a radial axis 534 of the bottom mating features 518 of the rotational element 514. The rotatable fluid port 528 may also include a third port mating feature 536 and a fourth port mating feature 538 positioned on an opposite side of the rotatable fluid port 528 as the third port mating feature 536. Thus, the rotatable fluid port 528 may be x-shaped, with a radial axis of the two segments of the x being orthogonal or substantially orthogonal to one another. The third port mating feature 536 and fourth port mating feature 538 may each be rotatably coupled with a connector mating feature 526 such that the connectors 522 are rotatable about a radial axis 540 of the third port mating feature 536 and the fourth port mating feature 538. The radial axis 540 may be substantially orthogonal to the radial axis of the bottom mating features 518 such that the frame of the cleaning device is pivotable relative to the shaft about at least two substantially orthogonal axes.

The LCU joint 500 defines part of a rigid fluid path that helps direct fluid from a fluid source, such as hose 108, to one or more fluid apertures of a frame of the cleaning device. The rigid fluid path may include the fluid conduit of a shaft, the interior 512 of the nozzle 502, the nozzle apertures 510, the conduits 520 of rotational elements 514, the rotatable fluid port 528, the connector conduits 524, and the one or more fluid apertures define a rigid fluid path configured to direct a fluid from the fluid source to the cleaning element. Such a fluid path enables the rotation of the frame relative to the shaft without bending any components that define the rigid fluid path. The components may rotate relative to one another, thus changing a shape of the fluid path, but none of the individual components bend to a different shape.

Figure 6:
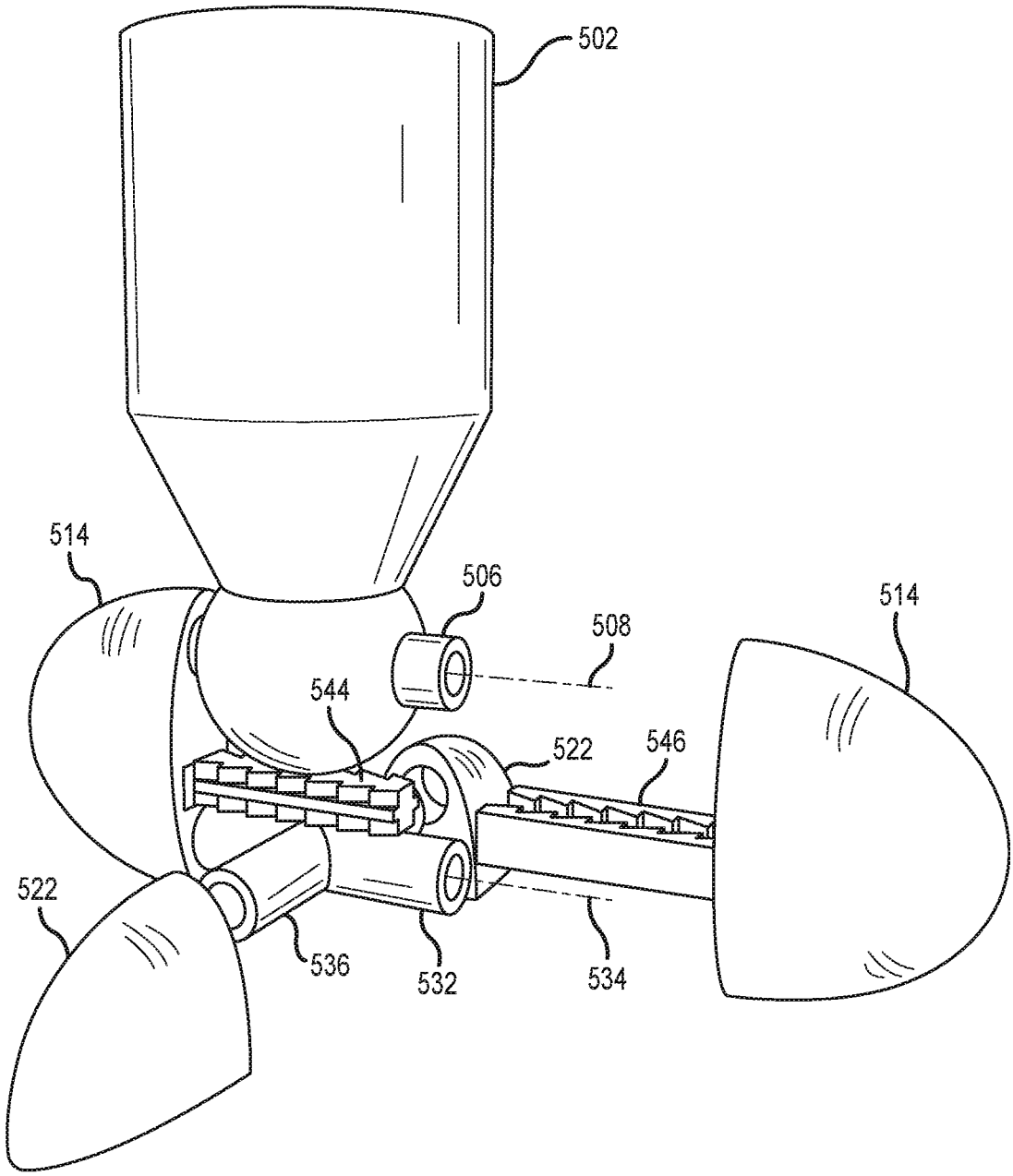
FIG. 6 shows a partially assembled view of the LCU joint of FIG. 5 according to embodiments.
Figure 7:
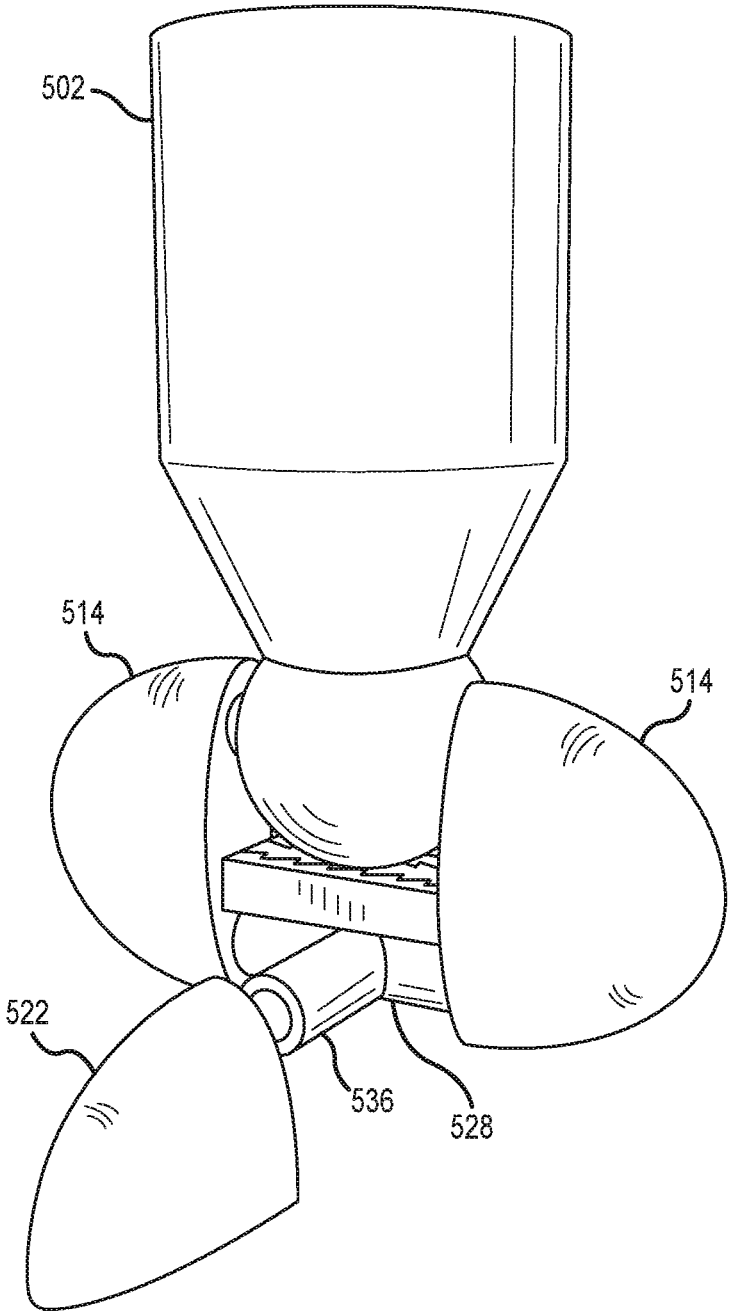
FIG. 7 shows a partially assembled view of the LCU joint of FIG. 5 according to embodiments.

FIG. 6 shows LCU joint 500 in a partially assembled configuration. Here, one of the rotational elements 514 is coupled with a nozzle mating feature 504 and a first port mating feature 530. This allows the rotational element 514 to rotate about the radial axis 508. In this embodiment, the coupling of the two rotational elements 514 with the nozzle 502 and rotatable fluid port 528 may be done with a fastening mechanism 542. As shown, fastening mechanism 542 may include a ratcheting feature, with one of the rotational elements 514 having a toothed member 544 configured to be received within and secured by a toothed slot 546. As the toothed member 544 and toothed slot 546 are engaged with one another, the rotational elements 514 may be secured with one another, and may couple the nozzle 502, rotational elements 514, and rotatable fluid port 528 as a single unit. It will be appreciated that other fastening mechanisms may be used to secure the components together, and the fastening mechanism may be on the rotational element 514 and/or other components of the LCU joint 500 as seen in FIG. 7. In some embodiments, the two possible axes of rotation, 508 and 534, may coexist in parallel or one of the axes may be fixed and isolated from rotation. In some embodiments, the mating features themselves may serve to removably or permanently couple the components together when engaged with a corresponding mating feature of another component. For example, snap connectors may be used to couple each mating feature with a corresponding mating feature. As one example, the nozzle mating feature 504 may include an enlarged outer edge that may be received within a channel inside of the top mating feature 516. The enlarged outer edge may be snapped into the channel such that the nozzle 502 and rotational element 514 are rotatably coupled with one another. This allows the rotatable fluid port 528 to rotate about radial axis 534.

Figure 8:
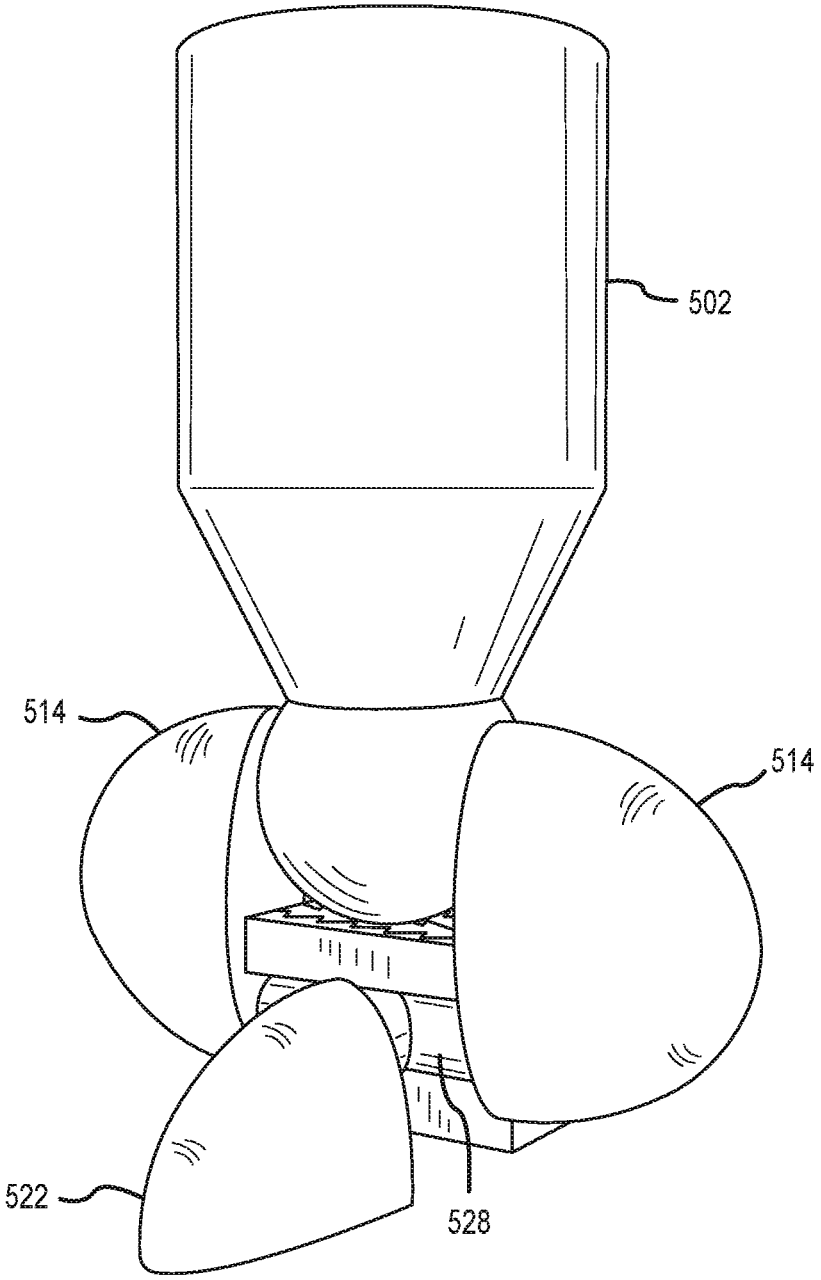
FIG. 8 shows an assembled view of the LCU joint of FIG. 5 according to embodiments.

FIG. 8 shows the LCU joint 500 fully assembled. Here, connectors 522 may be coupled with the third port mating feature 536 and the fourth port mating feature 538. The connectors 522 are rotatable about radial axis 540, which may be orthogonal to one or both of radial axis 508 and radial axis 534. In some embodiments, the connectors 522 may be coupled by the engagement of the connector mating features 526 with the third port mating feature 536 and the fourth port mating feature 538. In other embodiments, the connectors 522 may be coupled to the frame of the cleaning device, and the frame may determine a distance between the connectors 522 such that the rotatable fluid port 528 is engaged and in fluid communication with the connectors 522.

The various mating features of the LCU joint may include tubes configured to insert into apertures. It will be appreciated that the position of tubes and apertures shown in FIGS. 5-8 may be reversed. The tubes may be press or slip fit within apertures or otherwise rotatably secured. Other mating features may include snaps, such as tubes with an enlarged edge that may be received and secured within a channel of an aperture. The edge may allow for rotation within the channel while resisting removal from the aperture. Any other coupling technique that allows for rotation around a radial axis of at least one of the mating features may be used, such as magnetic couplings.

In some embodiments, O-rings, gaskets, and/or other seals may be included within the juncture of mounting features to ensure that the fluid path defined by the LCU joint is leak-proof and can maintain fluid pressure. In some embodiments, gears, ratchet mechanisms, and/or other friction force and/or normal force enhancing mechanisms may be included at these junctures to help maintain the frame at a desired position and to prevent the frame and cleaning element from flopping around. For example, a spur gear coupled to and/or formed on a tube may mesh with an internal ring gear within an aperture. The spur gear may rotate within the internal ring gear when sufficient force is applied by the user, but friction and normal force from the intermeshed teeth may help prevent the frame and cleaning element from flopping around.

As noted above, an LCU joint may be asymmetrical, with one or more of the components being singularly used. As one example, an LCU joint may include a nozzle and other components as described in FIGS. 5-8. The nozzle may be coupled to the distal end of the cleaning device shaft such that an interior of the nozzle is in fluid communication with the fluid conduit. In some embodiments, the nozzle may include a single nozzle mating feature that defines a nozzle aperture. A rotational element, similar to rotational element 514, having a top mating feature and a bottom mating feature may be rotatably coupled with the nozzle mating feature such that the rotational element is rotatable about a radial axis of the nozzle mating feature. The rotational element may define a conduit that extends between the top mating feature and the bottom mating feature. A single connector may be coupled with the mounting or frame of the cleaning device. The connector may define a connector conduit in fluid communication with a connector mating feature and the one or more fluid apertures of the frame. A rotatable fluid port having a first port mating feature and a second port mating feature may be coupled with the rotational element and the connector. For example, the first port mating feature may be rotatably coupled with the second mating feature such that the rotatable fluid port is rotatable about a radial axis of the second mating feature. The second port mating feature may be rotatably coupled with the connector mating feature such that the connector is rotatable about a radial axis of the second port mating feature. The radial axis of the second port mating feature may be substantially orthogonal to the radial axis of the second mating feature such that the mounting is pivotable relative to the shaft about two substantially orthogonal axes. The fluid conduit, the interior of the nozzle, the nozzle aperture, the conduit, the rotatable fluid port, the connector conduit, and the one or more fluid apertures may define a rigid fluid path configured to direct a fluid from the fluid source to the cleaning element that enables the rotation of the frame of the cleaning device relative to the shaft without bending any components that define the rigid fluid path.

Figure 9:
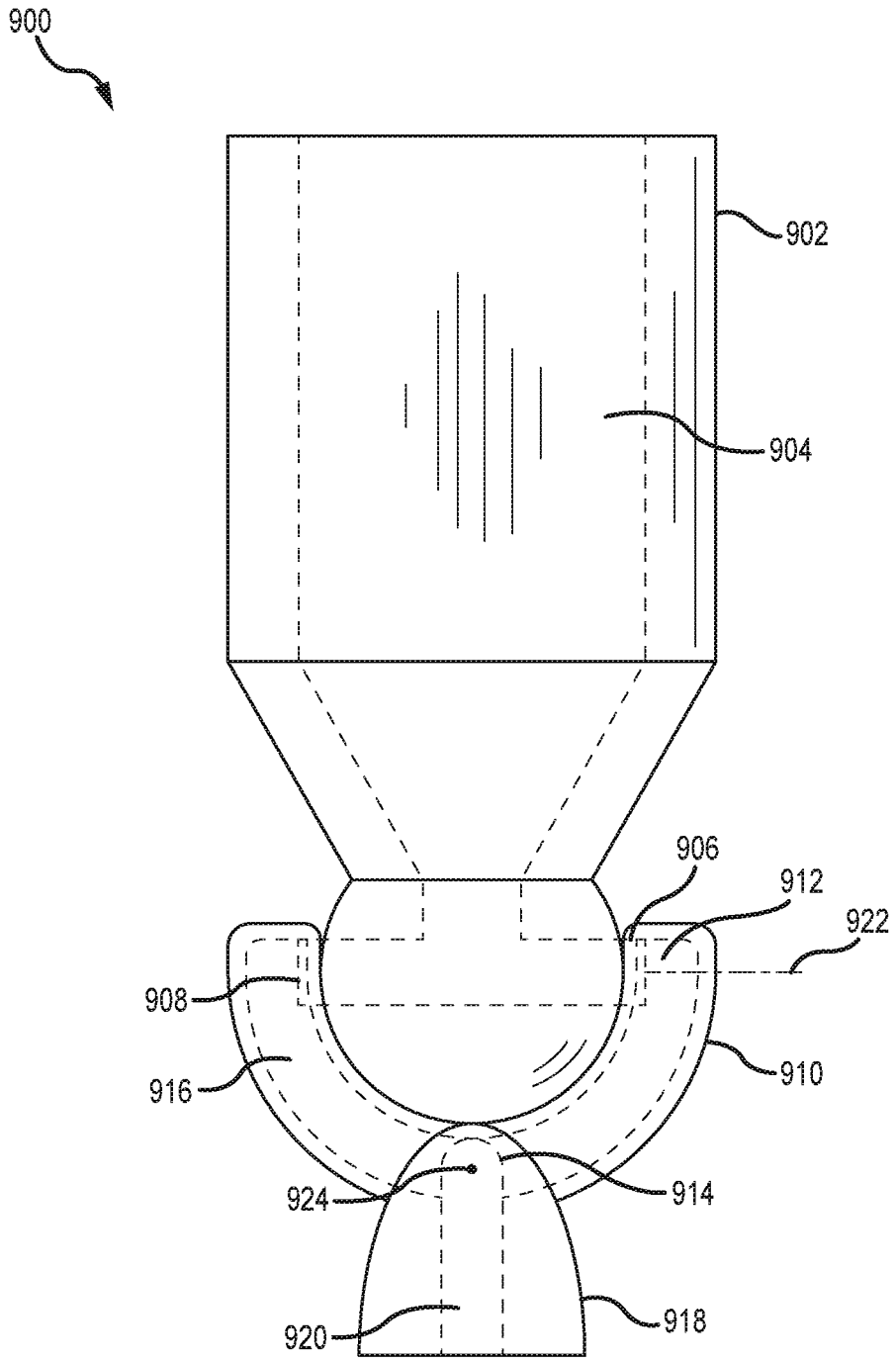
FIG. 9 shows an embodiment of an LCU joint according to embodiments.

In another embodiment shown in FIG. 9, an LCU joint 900 may include a nozzle 902 coupled to the distal end of the shaft such that an interior 904 of the nozzle 902 is in fluid communication with the fluid conduit. The nozzle 900 may include one or more nozzle mating features 906, with each nozzle mating feature 906 defining a nozzle aperture 908. A rotational element 910 having at least one top mating feature 912 and at least one bottom mating feature 914 may be coupled with the one or more nozzle mating features 906. Each of the top mating features 912 may be rotatably coupled with a corresponding nozzle mating feature 906 such that the rotational element 910 is rotatable about a radial axis 922 of the nozzle mating features 906. The rotational element 910 may define a conduit 916 that extends between the one or more top mating features 912 and the one or more bottom mating features 914. A connector 918 may be coupled with a mounting frame of the cleaning device. The connector 918 may define a connector conduit 920 in fluid communication with one or more connector mating features and one or more fluid apertures of the mounting. The one or more connector mating features may be rotatably coupled with the one or more bottom mating features 914 such that the connector 918 is rotatable about a radial axis 924 of the one or more bottom mating features. The radial axis 922 of the nozzle mating features 906 is substantially orthogonal to the radial axis 924 of the bottom mating features 914 such that the cleaning element mounting is pivotable relative to the shaft about two substantially orthogonal axes. The fluid conduit of the shaft, the interior 904 of the nozzle 902, the nozzle aperture 908, the conduit 916, the connector conduit 920, and the one or more fluid apertures of the mounting frame define a rigid fluid path configured to direct a fluid from the fluid source to the cleaning element. The rigid fluid path enables the rotation of the mounting relative to the shaft without bending any components that define the rigid fluid path.

Figure 10:
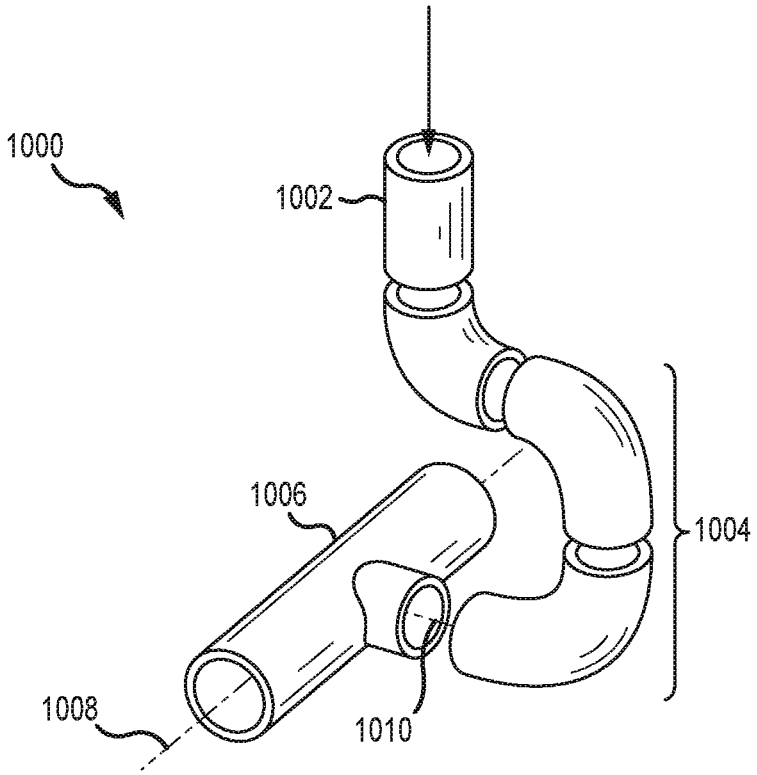
FIG. 10 shows an embodiment of an LCU joint according to embodiments.

FIG. 10 depicts an embodiment of an LCU joint 1000. A nozzle 1002 of LCU joint 1000 may be coupled with a distal end of a shaft of a cleaning device. Nozzle 1002 may be coupled with one or more conduit members 1004. Conduit members 1004 may direct fluid from nozzle 1002 into a rotational element 1006. Rotational element 1006 may be coupled with one or more connectors and/or with a mounting frame of a cleaning device. Rotational element 1006 may be configured to rotate about a radial axis 1010 of the conduit members 1004. Rotational element 1006 may further define a radial axis 1008 about which one or more connectors and/or a frame may rotate. Radial axes 1008 and 1010 are substantially orthogonal to one another. As in other embodiments, LCU joint 1000 defines rigid fluid path configured to direct a fluid from the fluid source to the cleaning element. The rigid fluid path enables the rotation of the mounting relative to the shaft without bending any components that define the rigid fluid path.

Figure 11:
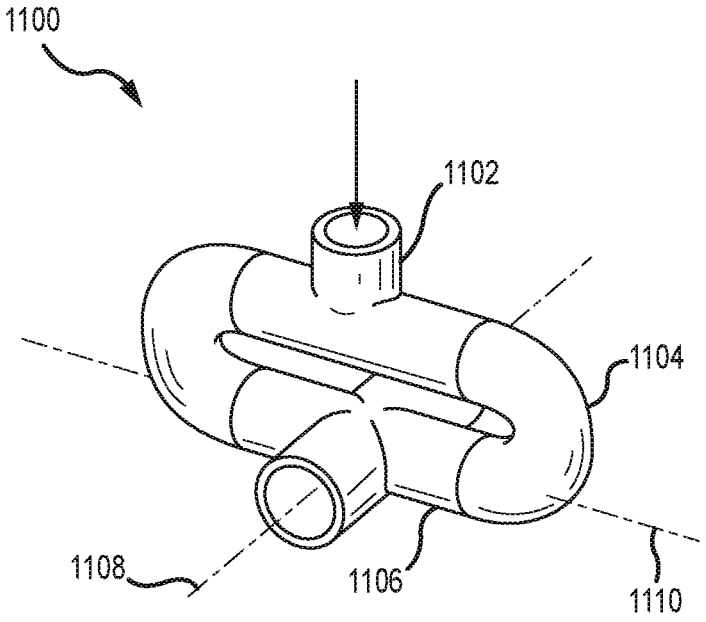
FIG. 11 shows an assembled view of the LCU joint of FIG. 5 according to embodiments.

FIG. 11 depicts an embodiment of an LCU joint 1100. A nozzle 1102 of LCU joint 1100 may be coupled with a distal end of a shaft of a cleaning device. Nozzle 1102 may be coupled with one or more rotational elements 1104. Rotational elements 1104 may define conduits that direct fluid from nozzle 1102 to a rotational conduit 1106. Rotational conduit 1106 may be configured to rotate about a radial axis 1110 of the rotational elements 1104. Rotational conduit 1106 may further define a radial axis 1108 about which one or more connectors and/or a frame may rotate. Radial axes 1108 and 1110 are substantially orthogonal to one another. As in other embodiments, LCU joint 1100 defines rigid fluid path configured to direct a fluid from the fluid source to the cleaning element. The rigid fluid path enables the rotation of the mounting relative to the shaft without bending any components that define the rigid fluid path.

Figure 12:
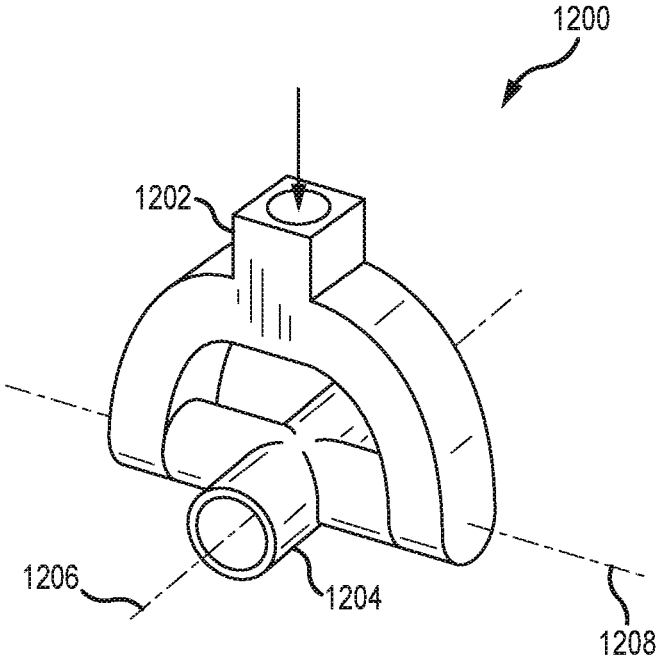
FIG. 12 shows an embodiment of an LCU joint according to embodiments.

FIG. 12 depicts an embodiment of an LCU joint 1200. A nozzle 1202 of LCU joint 1200 may be coupled with a distal end of a shaft of a cleaning device. Nozzle 1202 may be rotatably coupled with a rotational conduit 1204. For example, rotational conduit 1204 may be configured to be coupled between forks of nozzle 1202. Rotational conduit 1204 may be configured to rotate about a radial axis 1208 of the nozzle 1202. Rotational conduit 1204 may further define a radial axis 1206 about which one or more connectors and/or a frame may rotate. Radial axes 1206 and 1208 are substantially orthogonal to one another. As in other embodiments, LCU joint 1200 defines rigid fluid path configured to direct a fluid from the fluid source to the cleaning element. The rigid fluid path enables the rotation of the mounting relative to the shaft without bending any components that define the rigid fluid path.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

What is claimed is:

1. A cleaning device comprising:

a shaft having a proximal end and a distal end, the proximal end being configured to interface with a fluid source, the shaft comprising a fluid conduit extending along a length of the shaft;

a mounting frame coupled with a cleaning element, the mounting frame defining a frame interior in communication with one or more fluid apertures; and a liquid conducting universal joint coupled with the mounting frame and the distal end of the shaft such that the mounting frame is pivotally coupled with the shaft, the liquid conducting universal joint comprising:

a nozzle coupled to the distal end of the shaft such that an interior of the nozzle is in fluid communication with the fluid conduit, the nozzle comprising a nozzle mating feature, the nozzle mating feature defining a nozzle aperture;

a rotational element having a first mating feature and a second mating feature, the first mating feature rotatably coupled with the nozzle mating feature such that the rotational element is rotatable about a radial axis of the nozzle mating feature, the rotational element defining a conduit that extends between the first mating feature and the second mating feature;

a connector coupled with the mounting, the connector defining a connector conduit in fluid communication with a connector mating feature and the one or more fluid apertures; and a rotatable fluid port comprising a first port mating feature and a second port mating feature, the first port mating feature being rotatably coupled with the second mating feature such that the rotatable fluid port is rotatable about a radial axis of the second mating feature, the second port mating feature being rotatably coupled with the connector mating feature such that the connector is rotatable about a radial axis of the second port mating feature, wherein:

the radial axis of the second port mating feature is substantially orthogonal to the radial axis of the second mating feature such that the mounting frame is pivotable relative to the shaft about two substantially orthogonal axes;

the fluid conduit, the interior of the nozzle, the nozzle aperture, the conduit, the rotatable fluid port, the connector conduit, the frame interior, and the one or more fluid apertures define a rigid fluid path configured to direct a fluid from the fluid source to the cleaning element;

the rigid fluid path enables the rotation of the mounting frame relative to the shaft without bending any components that define the rigid fluid path.

2. The cleaning device of claim 1, wherein:

at least some of the one or more fluid apertures comprise an adjustable valve that controls a pressure of the fluid.

3. The cleaning device of claim 1, wherein:

the one or more fluid apertures are configured to soak the cleaning element with the fluid.

4. The cleaning device of claim 1, wherein:

the shaft comprises a flow actuator configured to control a flow of the fluid through the fluid path.

5. The cleaning device of claim 4, wherein:

the flow actuator is lockable in a plurality of positions, each of the plurality of positions corresponding to a different fluid flow rate.

6. The cleaning device of claim 1, wherein:
the shaft comprises:
a compartment configured to store a cleaning product, the compartment comprising a valve configured to seal the compartment from the fluid conduit when in a closed position; and
a compartment actuator configured to manipulate the valve from the closed position to the open position, wherein in the open position the valve introduces the cleaning product to the fluid conduit.

7. A cleaning device comprising:
a shaft having a proximal end and a distal end, the proximal end being configured to interface with a fluid source, the shaft comprising a fluid conduit extending along a length of the shaft;
a mounting frame coupled with a cleaning element, the mounting frame defining a frame interior in communication with one or more fluid apertures; and
a liquid conducting universal joint coupled with the mounting frame and the distal end of the shaft such that the mounting frame is pivotally coupled with the shaft, the liquid conducting universal joint comprising:
a nozzle coupled to the distal end of the shaft such that an interior of the nozzle is in fluid communication with the fluid conduit, the nozzle comprising a nozzle mating feature, the nozzle mating feature defining a nozzle aperture;
a rotational element having a first mating feature and a second mating feature, the first mating feature rotatably coupled with the nozzle mating feature such that the rotational element is rotatable about a radial axis of the nozzle mating feature, the rotational element defining a conduit that extends between the first mating feature and the second mating feature; and
a connector coupled with the mounting, the connector defining a connector conduit in fluid communication with a connector mating feature and the one or more fluid apertures, the connector mating feature rotatably coupled with the second mating feature such that the connector element is rotatable about a radial axis of the second mating feature, wherein:
the radial axis of the nozzle mating feature is substantially orthogonal to the radial axis of the second mating feature such that the mounting frame is pivotable relative to the shaft about two substantially orthogonal axes;
the fluid conduit, the interior of the nozzle, the nozzle aperture, the conduit, the connector conduit, the frame interior, and the one or more fluid apertures define a rigid fluid path configured to direct a fluid from the fluid source to the cleaning element;
the rigid fluid path enables the rotation of the mounting frame relative to the shaft without bending any components that define the rigid fluid path.

8. The cleaning device of claim 7, wherein:
the one or more fluid apertures each comprise an adjustable valve that controls a pressure of the fluid.

9. The cleaning device of claim 7, wherein:
the shaft comprises a flow actuator configured to control a flow of the fluid through the fluid path.

10. The cleaning device of claim 9, wherein:
the flow actuator is lockable in a plurality of positions, each of the plurality of positions corresponding to a different fluid flow rate.

11. The cleaning device of claim 7, wherein:
the fluid conduit comprises an interior of the shaft.

12. The cleaning device of claim 7, wherein:
the shaft comprises:
a compartment configured to store a cleaning product, the compartment comprising a valve configured to seal the compartment from the fluid conduit when in a closed position; and
a compartment actuator configured to manipulate the valve from the closed position to the open position, wherein in the open position the valve introduces the cleaning product to the fluid conduit.

13. A cleaning device comprising:
a shaft having a proximal end and a distal end, the proximal end being configured to interface with a fluid source, the shaft comprising a fluid conduit extending along a length of the shaft;
a conduit coupled with the distal end of the shaft such that the conduit is rotatable about a first axis of the conduit;
a mounting frame coupled with the conduit and configured to rotate about a second axis of the conduit, the mounting frame coupled with a cleaning element, the mounting frame defining a frame interior in communication with one or more fluid apertures, wherein:
the first axis is substantially orthogonal to the second axis such that the mounting frame is pivotable relative to the shaft about two degrees of freedom;
the fluid conduit, the conduit, the frame interior, and the one or more fluid apertures define a continuous and rigid fluid path configured to direct a fluid from the fluid source to the cleaning element; and
the continuous and rigid fluid path enables the rotation of the mounting frame relative to the shaft without bending any components that define the rigid fluid path.

14. The cleaning device of claim 13, wherein:
the shaft comprises a telescoping shaft such that the length of the shaft is adjustable.

15. The cleaning device of claim 13, wherein:
the one or more fluid apertures are configured to direct the fluid through corresponding apertures defined by the cleaning element such that the fluid is applied directly to a surface to be cleaned.

16. The cleaning device of claim 13, wherein:
the fluid conduit comprises an interior of the shaft.

17. The cleaning device of claim 13, wherein:
the fluid conduit extends along an outer periphery of the shaft.

18. The cleaning device of claim 13, wherein:
the mounting is coupled with the cleaning element using one or more of a hook and loop fastener, a snap connector, or a magnetic connector.

19. The cleaning device of claim 13, wherein:
the shaft comprises a flow actuator configured to control a flow of the fluid through the fluid path.

20. The cleaning device of claim 13, wherein:
the shaft comprises:
a compartment configured to store a cleaning product, the compartment comprising a valve configured to seal the compartment from the fluid conduit when in a closed position; and
a compartment actuator configured to manipulate the valve from the closed position to the open position, wherein in the open position the valve introduces the cleaning product to the fluid conduit.

* * * * *